US006290061B1

(12) United States Patent
Chen

(10) Patent No.: US 6,290,061 B1
(45) Date of Patent: Sep. 18, 2001

(54) SUPPORTING DEVICE FOR A GOLF BAG

(75) Inventor: Jan-Nan Chen, Taichung (TW)

(73) Assignee: Chiu-Teh Chen, Taipei (TW)

( * ) Notice: Subject to any disclaimer, the term of this patent is extended or adjusted under 35 U.S.C. 154(b) by 0 days.

(21) Appl. No.: 09/480,770

(22) Filed: Jan. 10, 2000

(51) Int. Cl.[7] ..... A63B 55/00
(52) U.S. Cl. ..... 206/315.7; 248/96; 206/315.8
(58) Field of Search ..... 248/96; 206/315.3, 206/315.7, 315.8

(56) References Cited

U.S. PATENT DOCUMENTS

| | | | | |
|---|---|---|---|---|
| Re. 36,366 | * | 11/1999 | Suk | 248/96 |
| 1,686,774 | * | 10/1928 | Sperry | 248/96 |
| 1,970,849 | * | 8/1934 | Gunther | 248/96 |
| 1,978,230 | * | 10/1934 | Schutes | 248/96 |
| 1,982,388 | * | 11/1934 | Huehn | 248/96 |
| 5,816,399 | * | 10/1998 | Rhee | 206/315.7 |
| 5,829,719 | * | 11/1998 | Han | 248/96 |
| 5,860,521 | * | 1/1999 | Wu | 206/315.7 |
| 5,901,845 | * | 5/1999 | Cheng | 206/315.7 |
| 5,904,326 | * | 5/1999 | Riu | 248/96 |
| 6,220,433 | * | 4/2001 | Kang | 206/315.7 |

FOREIGN PATENT DOCUMENTS

| | | | | |
|---|---|---|---|---|
| 1182/31 | * | 3/1931 | (AU) | 248/96 |

* cited by examiner

*Primary Examiner*—Anita King
*Assistant Examiner*—Jon Szumny
(74) *Attorney, Agent, or Firm*—Alan Kamrath; Rider, Bennett, Egan & Arundel, LLP

(57) ABSTRACT

A supporting device for a golf bag includes a head frame mounted to an upper end of the golf bag, a mounting seat fixedly mounted to the upper end of the golf bag and fixedly mounted to a side of the head frame, and a post including an upper end fixedly connected to the head frame and the mounting seat, the post extending through a longitudinal length of the golf bag. The post, the head frame, and the mounting seat provide a reliable support for the golf bag.

4 Claims, 6 Drawing Sheets

SUPPORTING DEVICE FOR A GOLF BAG

BACKGROUND OF THE INVENTION

1. Field of the Invention

The present invention relates to a golf bag having an improved supporting device for reliably supporting the golf bag in an inclined status.

2. Description of the Related Art

A typical golf bag may stand in an upright manner or be supported in an inclined status by a supporting device attached to the golf bag. FIG. 1 of the drawings illustrates a conventional supporting device for a golf bag 11. The supporting device includes two supporting rods 10, a support base 12, and two strips 13. Each strip 13 includes an upper end pivotally attached to an upper portion of an associated supporting rod 10 and a lower end securely attached to the support base 12. Thus, the golf bag 11 may either stand in an upright manner (FIG. 2) or be supported in an inclined status (FIG. 3). Nevertheless, when loaded with golf clubs, the golf bag tends to rock since it is only supported by the support rods 10.

The present invention is intended to provide a supporting device for a golf bag that mitigates and/or obviates the above problems.

SUMMARY OF THE INVENTION

In accordance with the present invention, a supporting device for a golf bag comprises a head frame mounted to an upper end of the golf bag, a mounting seat fixedly mounted to the upper end of the golf bag and fixedly mounted to a side of the head frame, and a post including an upper end fixedly connected to the head frame and the mounting seat, the post extending through a longitudinal length of the golf bag. Thus, the post, the head frame, and the mounting seat provide a reliable support for the golf bag.

Two supporting rods are provided and each of which has an upper end pivotally connected to the mounting seat. The supporting rods are pivotable to a status for supporting the golf bag in an inclined status with the lower ends of the supporting rods located on the ground. Two strips are provided and each of which has an upper end attached to the mounting seat and a lower end attached to a support base.

In accordance with an embodiment of the invention, a supporting device for a golf bag comprises:

- a head frame mounted to an upper end of the golf bag;
- a mounting seat fixedly mounted to the upper end of the golf bag and fixedly mounted to a side of the head frame;
- a post including an upper end fixedly connected to the head frame and the mounting seat, the post extending through a longitudinal length of the golf bag;
- a support base adapted to be located on the ground;
- two strips each including an upper end attached to the mounting seat and a lower end attached to the support base; and
- a strip-holding member through which the strips extend, the strip-holding member being slidably attached to the strips to hold the strips;
- whereby the supporting rods are pivotable to a status for supporting the golf bag in an inclined status with the lower ends of the supporting rods located on the ground, and whereby the post, the head frame, and the mounting seat provide a reliable support for supporting the golf bag in an inclined status.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
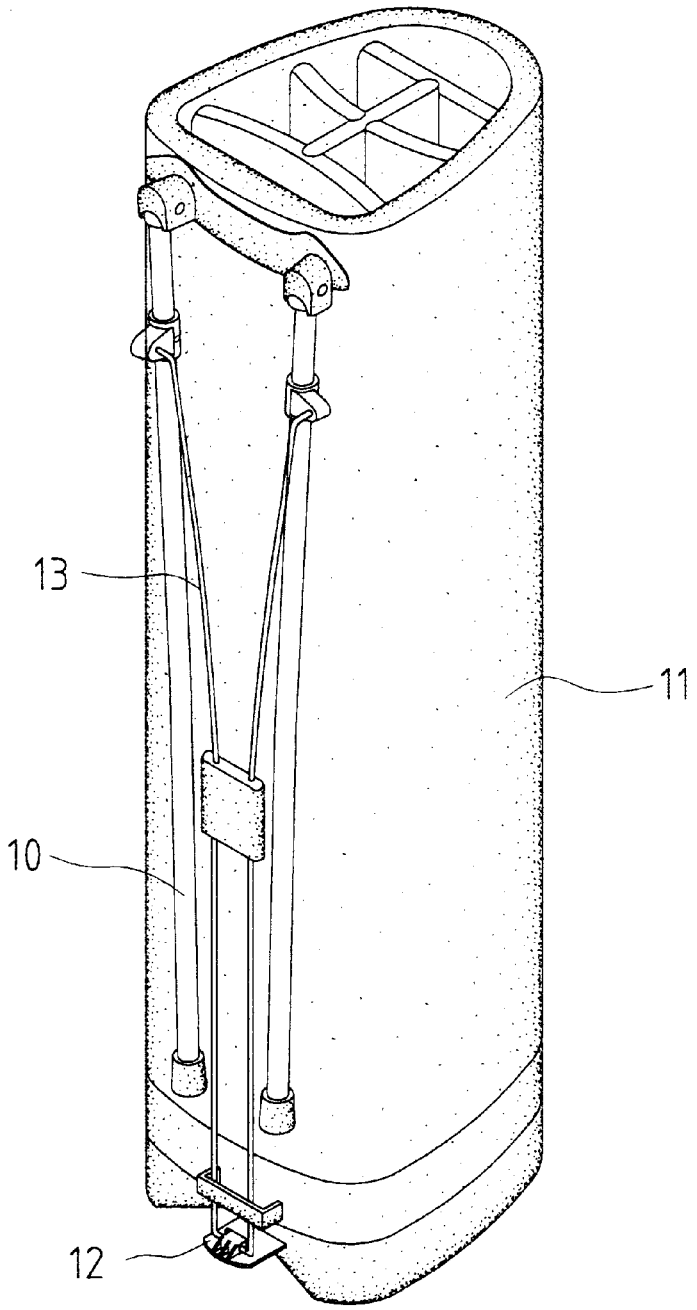
PRIOR ART Fig. 1
FIG. 1 is a perspective view of a golf bag with a conventional supporting device.
Figure 2:
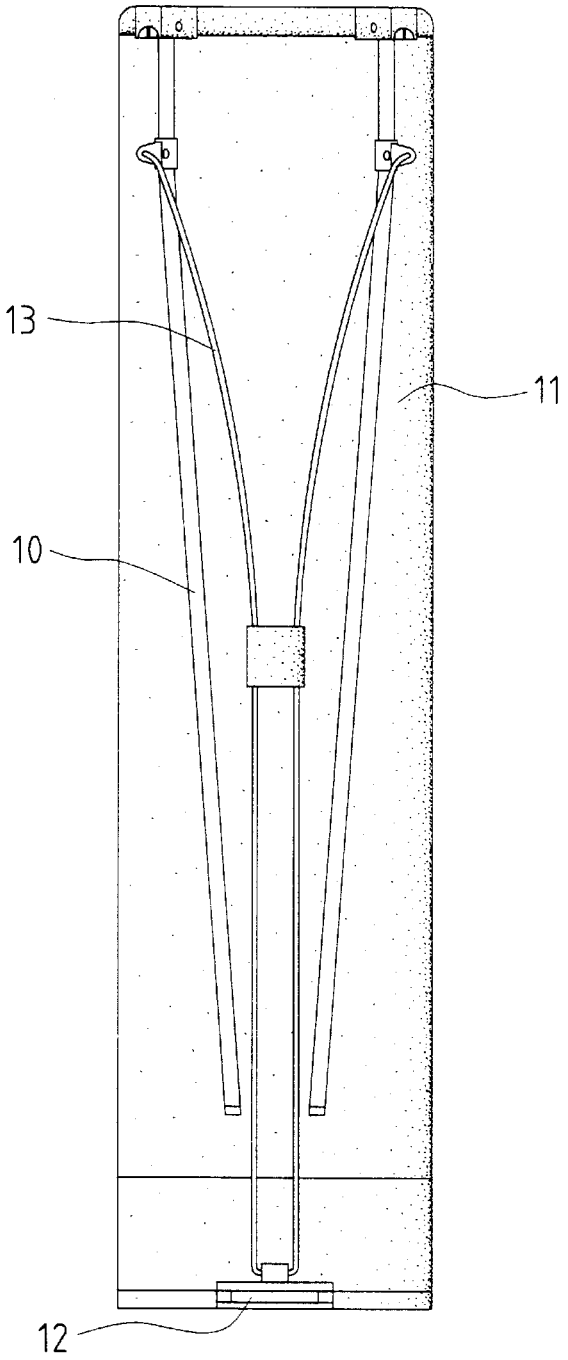
PRIOR ART Fig. 2
FIG. 2 is a rear view of the golf bag in FIG. 1.
Figure 3:
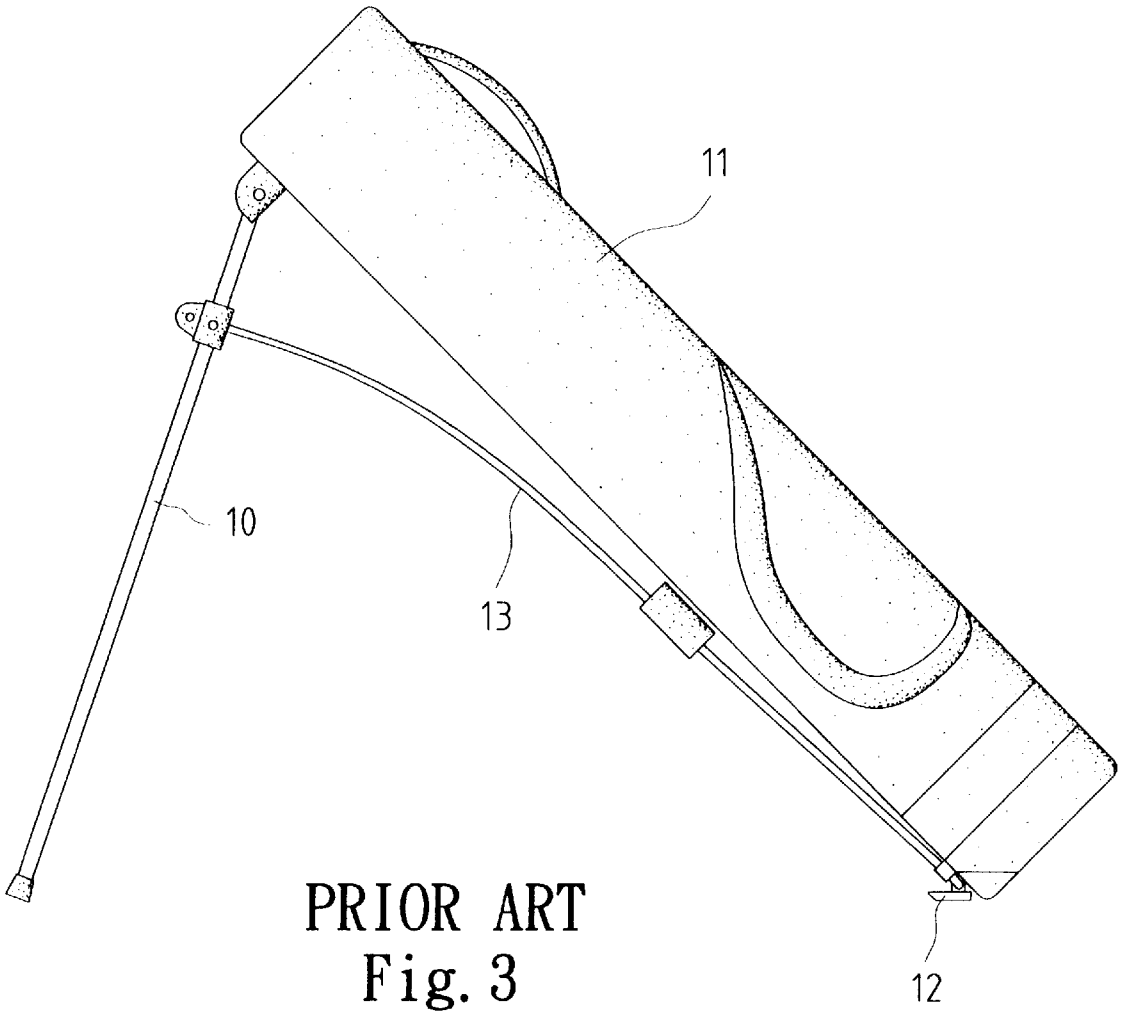
PRIOR ART Fig. 3
FIG. 3 is a side view of the golf bag in FIG. 1, wherein the golf bag is supported in an inclined status.
Figure 4:
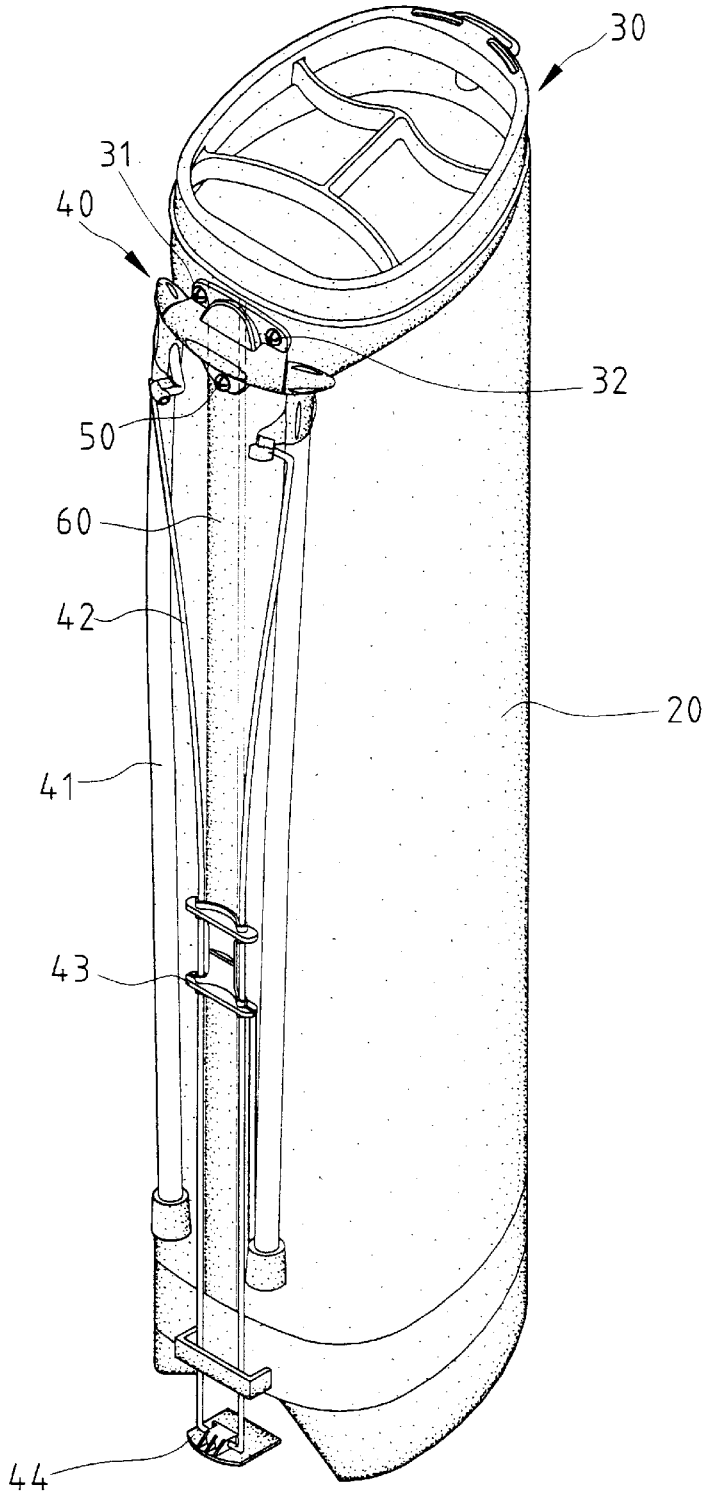
FIG. 4 is a perspective view of a golf bag with a supporting device in accordance with the present invention.
Figure 5:
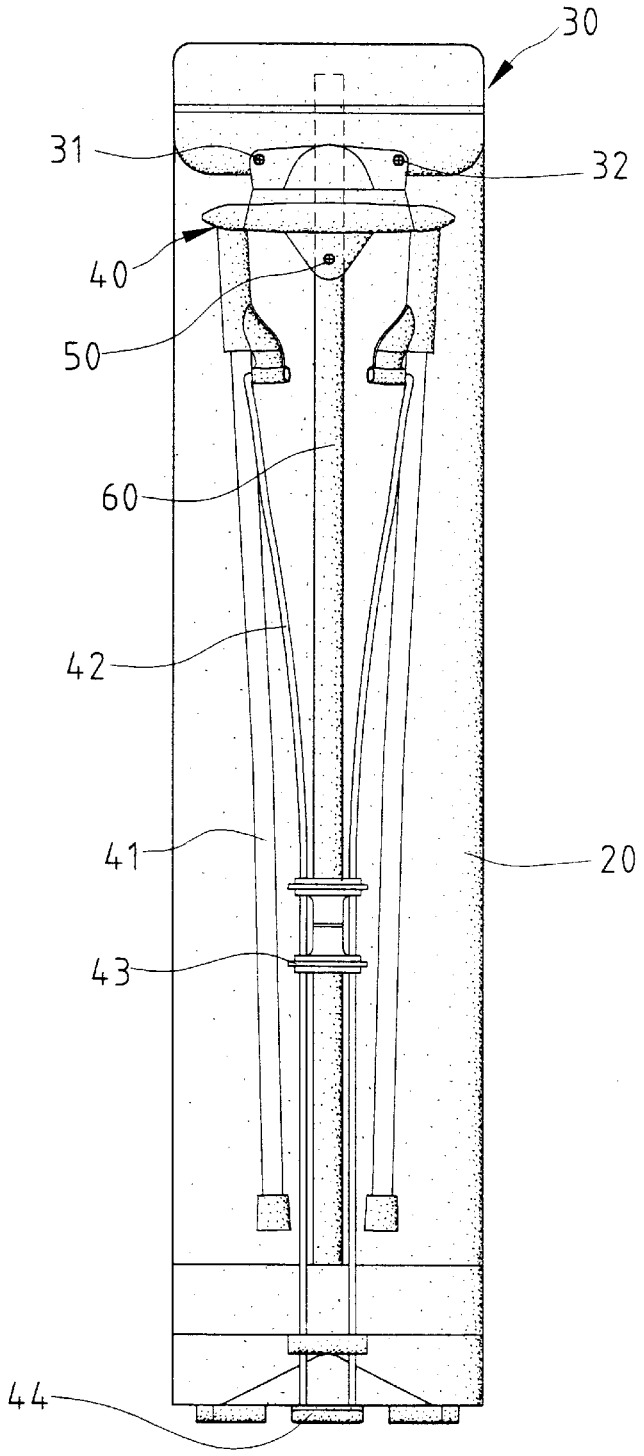
FIG. 5 is a rear view of the golf bag in FIG. 4.
Figure 6:
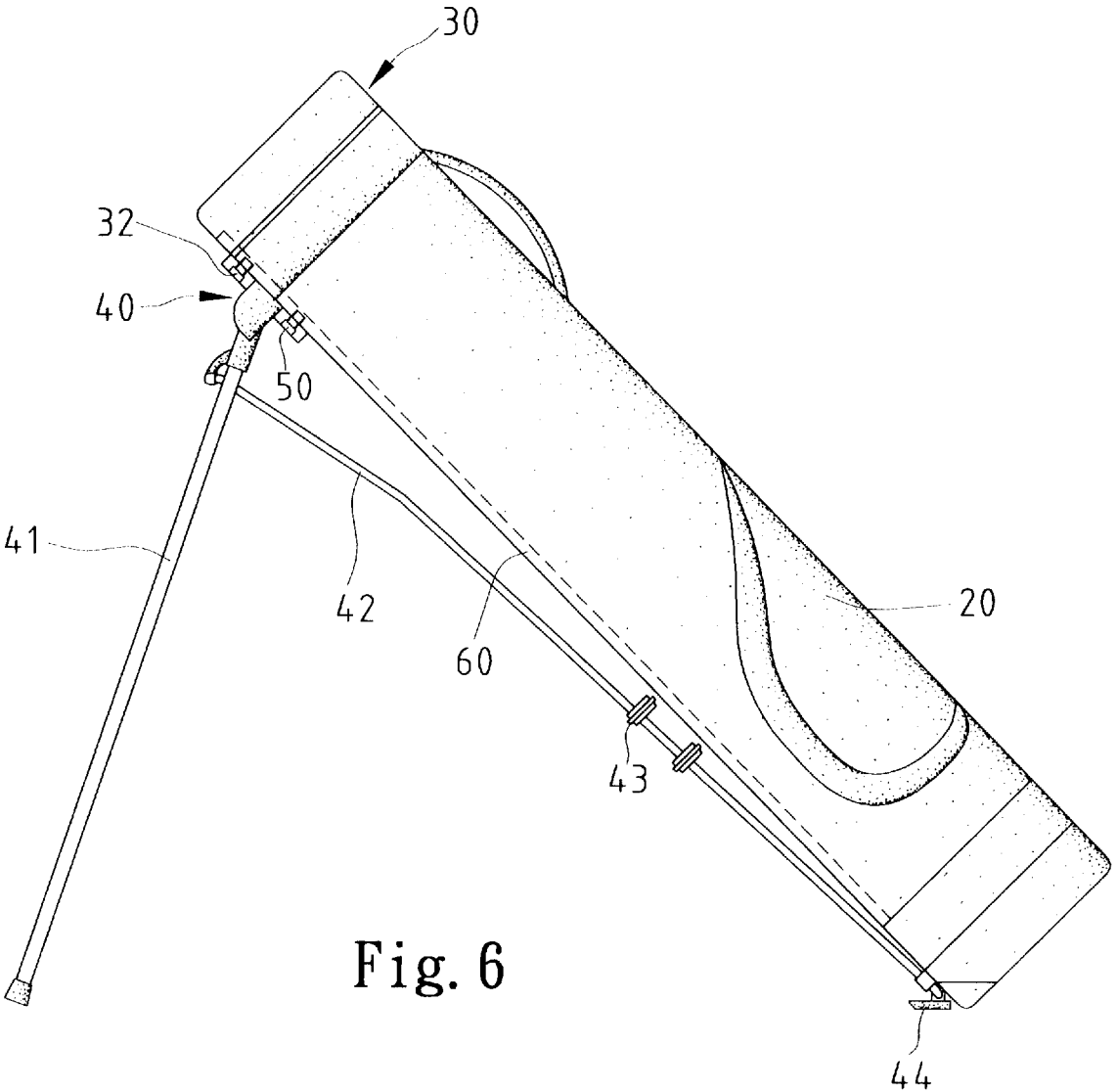
FIG. 6 is a side view of the golf bag in FIG. 4, wherein the golf bag is supported in an inclined status.

Referring to FIGS. 4 through 6 and initially to FIGS. 4 and 5, a supporting device in accordance with the present invention includes a head frame 30 fixed to an upper end of a golf bag 20. A mounting seat 40 is fixed to a rear side of the head frame 30 by screws 31 and 32. Two supporting rods 41 are provided and include upper ends pivotally mounted to two sides of the mounting seat 40, respectively. Lower ends of the supporting rods 41 may stand on the ground to support the golf bag 20 in an inclined status. Two strips 42 are provided and each of which includes an upper end attached to the mounting seat 40 and a lower end attached to a support base 44 that stands on the ground. A strip-holding member 43 is slidably attached to the strips 42 to hold the strips 42 such that lower portions of the strips 42 are maintained in an upright status. Thus, as illustrated in FIGS. 4 and 5, the golf bag 20 may stand in an upright manner and the support base 44 may be located on the ground to provide assistance to stable support. Referring to FIG. 6, the supporting rods 41 may be pivoted outward to support the golf bag 20 in an inclined status by the lower ends of the supporting rods 41 and the support base 44 that is still located on the ground to provide a stable support. In addition, a post 60 is mounted to the rear side the golf bag 20 and includes an upper end fixed to the mounting seat 40 by a screw 50. The post 60 is also securely connected to the head frame 30 and extends through a longitudinal length of the golf bag 20. Thus, reliable support for the golf bag 20 is provided due to provision of the post 60.

As illustrated in FIGS. 5 and 6, the post 60 is fixed to the head frame 30, the mounting seat 40 is also fixed to the head frame 30 by screws 31 and 32, and the post 60 is fixed to the mounting seat 40 by screw 50, thereby providing a firm connection. The post 60 provides improved support for the golf bag 20 to avoid swaying and falling of the latter even if the latter is supported in an inclined status.

Although the invention has been explained in relation to its preferred embodiment, it is to be understood that many other possible modifications and variations can be made without departing from the spirit and scope of the invention as hereinafter claimed.

What is claimed is:

1. A combination of a supporting device and a golf bag, comprising:

- a golf bag body having an upper end;
- a head frame mounted to the upper end of the golf bag body;

a mounting seat fixedly mounted to the upper end of the golf bag body and fixedly mounted to a side of the head frame by two first screws;

a post including an upper end fixedly connected to the head frame and extending intermediate and spaced from the two first screws, the post being fixed to the mounting seat by a second screw spaced from the head frame, the post extending through a longitudinal length of the golf bag body;

whereby the post, the head frame, and the mounting seat provide a reliable support for the golf bag body; and two supporting rods each having an upper end pivotally connected to the mounting seat and a lower end, the supporting rods being pivotable to a status for supporting the golf bag body in an inclined status with the lower ends of the supporting rods located on the ground.

2. The combination of a supporting device and a golf bag as claimed in claim 1, further comprising a support base adapted to be located on the ground and two strips each having an upper end attached to the mounting seat and a lower end attached to the support base.

3. A combination of a supporting device and a golf bag, comprising:

a golf bag body having an upper end;

a head frame mounted to the upper end of the golf bag body;

a mounting seat fixedly mounted to the upper end of the golf bag body and fixedly mounted to a side of the head frame by two first screws;

a post including an upper end fixedly connected to the head frame and extending intermediate and spaced from the two first screws, the post being fixed to the mounting seat by a second screw spaced from the head frame, the post extending through a longitudinal length of the golf bag body;

a support base adapted to be located on the ground;

two strips each including an upper end attached to the mounting seat and a lower end attached to the support base; and a strip-holding member through which the strips extend, the strip-holding member being slidably attached to the strips to hold the strips;

whereby the post, the head frame, and the mounting seat provide a reliable support for supporting the golf bag body in an inclined status.

4. The combination of a supporting device and a golf bag as claimed in claim 3, further comprising two supporting rods each having an upper end pivotally connected to the mounting seat and a lower end, the supporting rods being pivotable to a status for supporting the golf bag body in an inclined status with the lower ends of the supporting rods located on the ground.

* * * * *